US005572961A

United States Patent [19]

Schechter et al.

[11] Patent Number: 5,572,961

[45] Date of Patent: Nov. 12, 1996

[54] BALANCING VALVE MOTION IN AN ELECTROHYDRAULIC CAMLESS VALVETRAIN

[75] Inventors: Michael M. Schechter, Farmington Hills; Michael B. Levin, Birmingham, both of Mich.

[73] Assignee: Ford Motor Company, Dearborn, Mich.

[21] Appl. No.: 417,364

[22] Filed: Apr. 5, 1995

[51] Int. Cl.[6] ..... F01L 9/02

[52] U.S. Cl. ..... 123/90.12; 123/90.13

[58] Field of Search ..... 123/90.12, 90.13, 123/90.27

[56] References Cited

U.S. PATENT DOCUMENTS

| | | | |
|---|---|---|---|
| 3,682,152 | 8/1972 | Muller-Berner | 123/90.12 |
| 3,973,595 | 8/1976 | Schmoll | 137/637.1 |
| 4,174,687 | 11/1979 | Fuhrmann | 123/90.13 |
| 5,095,858 | 3/1992 | Ascari | 123/90.27 |
| 5,110,085 | 5/1992 | Iwasawa | 251/29 |
| 5,193,495 | 3/1993 | Wood, III | 123/90.12 |
| 5,255,641 | 10/1993 | Schechter | 123/90.12 |
| 5,259,345 | 11/1993 | Richeson | 123/90.12 |
| 5,275,136 | 1/1994 | Schechter et al. | 123/90.12 |
| 5,367,990 | 11/1994 | Schechter | 123/90.12 |
| 5,373,817 | 12/1994 | Schechter et al. | 123/90.12 |
| 5,375,419 | 12/1994 | Wright et al. | 60/607 |

FOREIGN PATENT DOCUMENTS

| | | |
|---|---|---|
| 2552492 | 9/1983 | France . |
| 5-202710 | 8/1993 | Japan . |

*Primary Examiner*—Weilun Lo
*Attorney, Agent, or Firm*—Donald A. Wilkinson

[57] ABSTRACT

A electrohydraulic engine valve control system in a multi-valve engine wherein multiple intake (or exhaust) valves (10) in each cylinder are hydraulically controlled by a set of hydraulic valves (64, 68). Each engine valve (10) includes a valve piston (26) subjected to fluid pressure acting on surfaces at both ends with the volume (27) at one end connected to a source of high pressure fluid (40) while a volume (25) at the other end is selectively connected to a source of high pressure fluid (40) and a source of low pressure fluid (42), and disconnected from each through action of the hydraulic valves (64, 68). Each group of corresponding engine valves (10) is linked hydraulically together and can be moved in unison. Balancing springs (80) operatively engaging each valve piston (26), to account for manufacturing tolerances and other factors, by balancing the motion of the engine valves (10) while opening and closing.

3 Claims, 1 Drawing Sheet

BALANCING VALVE MOTION IN AN ELECTROHYDRAULIC CAMLESS VALVETRAIN

FIELD OF THE INVENTION

The present invention relates to systems for variably controlling internal combustion engine intake and exhaust valves. More specifically, it relates to camless engine valve systems in multi-valve engines used to balance engine valve motion between valves within a cylinder.

This application is related to co-pending application Ser. No. 08/369,640 filed Jan. 6, 1995 and U.S. Pat. Nos. 5,419,301; 5,410,994, 5,404,844, 5,456,222, 5,456,221 and 5,456,223.

BACKGROUND OF THE INVENTION

The enhancement of engine performance that can be attained by varying the valve timing and lift as well as the acceleration, velocity and travel time of the intake and exhaust valves in an internal combustion engine is well known and appreciated in the art. Further, many contemporary engines are multi-valve engines that employ, for example, four valves per cylinder, i.e., 2 intake and two exhaust valves, to improve overall engine performance. As used herein, the term multi-valve engine means more than just one intake and one exhaust valve per cylinder in the engine, (i.e., a three-valve, four-valve, or five-valve per cylinder engine), although generally four valve per cylinder engines will be discussed herein.

In a four valve engine with an electrohydraulic valve train system that independently controls each engine valve, the balancing of valve lift can be performed by varying the electrical signals going to the different control means. However, independently controlling each engine valve with separate hydraulic valve controls is expensive and can require excessive space.

To reduce the number of hydraulic valve controls, the engine valves within a cylinder performing the same functions can be coupled together. That is, the pair of intake valves in each cylinder can be operated with the same hydraulic valves and controls; as well, the pair of exhaust valves in each cylinder can be similarly coupled together. It is desirable to be able to activate each pair of engine valves with substantially the same lift and timing for most engine operating conditions. But this is not always possible because of tolerances in manufacturing, viscous drag and other contributing factors that create slight differences between each engine valve in any given pair.

The need, then, arises for an electrohydraulic valvetrain that will work in a four valve (or other multi-valve) engine to ensure substantially identical lift and timing of each pair of engine valves when necessary, while not requiring separate independent controls for each engine valve in the valvetrain.

SUMMARY OF THE INVENTION

In its embodiments, the present invention contemplates a hydraulically operated valve control system for an internal combustion engine having at least one cylinder. The system includes a high pressure source of fluid and a low pressure source of fluid, and a cylinder head member adapted to be affixed to the engine, which includes an enclosed bore and chamber for each engine valve. A set of engine valves of a same function for the cylinder are shiftable between a first and second position within a respective cylinder head bore and chamber. A hydraulic actuator has a set of valve pistons, with each one coupled to a corresponding one of the engine valves and reciprocable within the enclosed chambers which thereby form first and second cavities in each chamber that vary in displacement as the engine valves move. A high pressure line extends within the cylinder head between the first and second cavities of each of the chambers and the high pressure source of fluid, and a low pressure line extends between the first cavities of each of the chambers and the low pressure source of fluid. The system further includes a high pressure valve and a low pressure valve for respectively regulating the flow of fluid in each of the first cavities, and control means cooperating with the high and low pressure valves for selectively coupling each of the first cavities to the high pressure and low pressure source to oscillate the set of engine valves in timed relation to engine operation. The system also includes a set of balancing springs, one each operatively engaging a respective valve piston wherein each of the balancing springs exerts a spring force on its respective valve piston that is less than the hydraulic forces acting on that valve piston from the first and second cavities.

Accordingly, it is an object of the present invention to provide an electrohydraulic valvetrain in a multi-valve engine that only requires one set of valve controls for each set of intake valves and one for each set of exhaust valves in a given cylinder, yet still assures substantially equivalent lift and timing between each valve within a set.

An advantage of the present invention is the cost and space savings incurred by coupling the sets of intake valves together and the sets of exhaust valves together in each given cylinder, while still allowing for balancing of the valve lift between the engine valves driven in parallel by the same actuators.

DETAILED DESCRIPTION OF THE PREFERRED EMBODIMENTS

Figure 1:
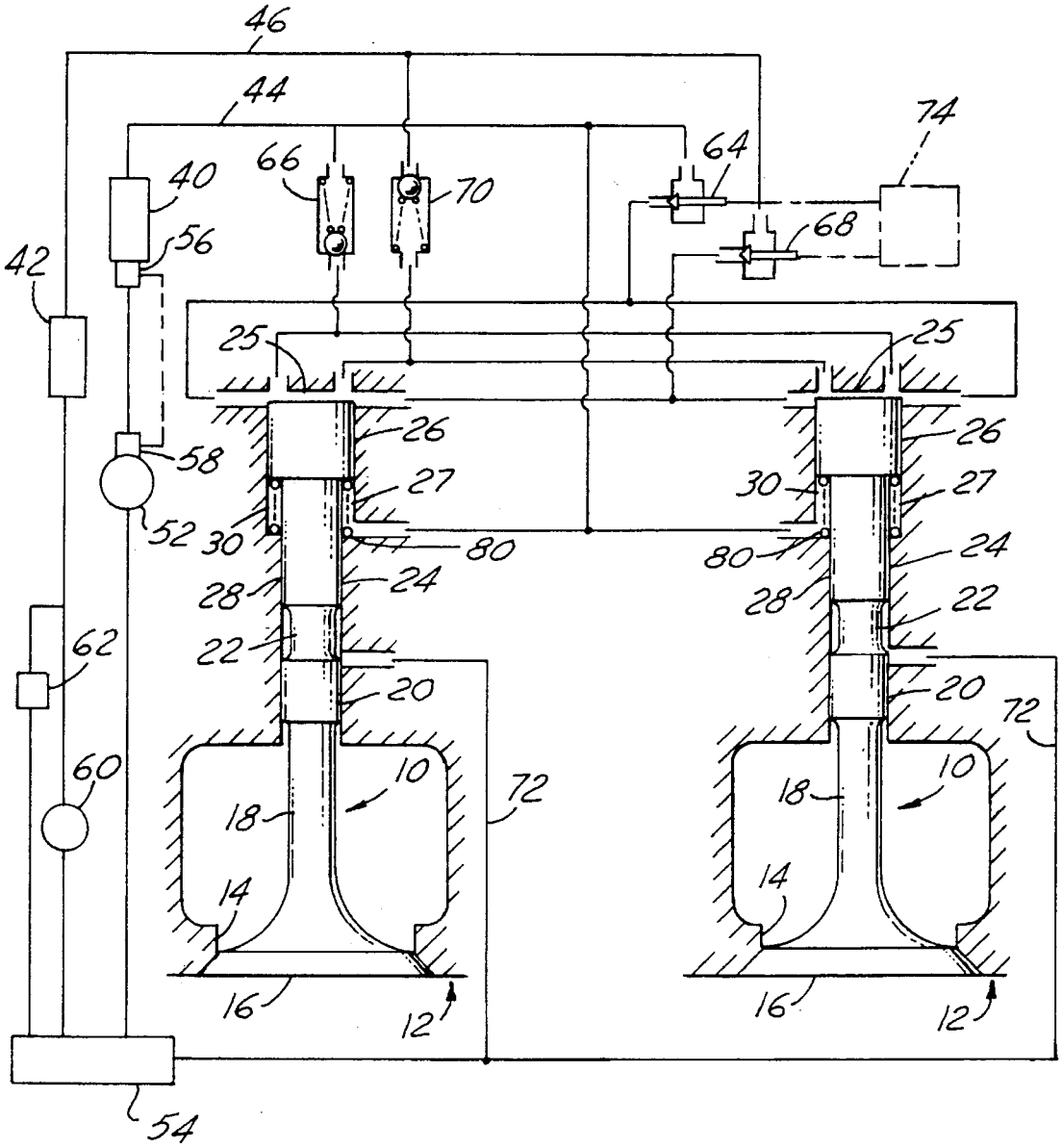
FIG. 1 is a schematic diagram showing a pair of electrohydraulically controlled engine valves in an assembly and a hydraulic system coupled to the pair of engine valves in accordance with the present invention.

The present invention provides variable control of engine valve timing, lift and velocity in an internal combustion engine. The system exploits elastic properties of compressed hydraulic fluid which, acting as a liquid spring, accelerates and decelerates engine valves during their opening and closing motions. The present invention further provides the ability to operate multiple intake (or exhaust) valves in a given cylinder within a multi-valve engine with a single set of valve controls and to allow for balancing the lift between the multiple intake (or exhaust) valves.

An electrohydraulic valvetrain is shown in detail in U.S. Pat. No. 5,255,641 to Schechter, and U.S. Pat. No. 5,373,817 to Schechter et al., which are incorporated herein by reference.

In a four valve engine there is a pair (set) of intake valves and a pair (set) of exhaust valves in each cylinder. The present discussion as illustrated in FIG. 1 discuss one set of engine valves (either intake or exhaust) in a four valve per cylinder engine. Nonetheless, the present invention will also work with other types of multi-cylinder engines where there are multiple engine valves in a given cylinder that perform the same function, (i.e., either multiple intake and/or multiple exhaust valves).

Since typically it is desirable for the motion of each engine valve in a set to be identical, the same valve control system can control a set of engine valves acting simultaneously. A diagram of such an arrangement for a set of engine valves is shown in FIG. 1. Each solenoid valve and each check valve is connected in an identical way to both engine valves. In such arrangement, activation of a solenoid valve will cause both engine valves to move substantially in unison.

Two engine valves 10 are shown connected to the same hydraulic system. The engine valves 10 are located within a cylinder head 12 that includes ports 14, for each valve 10, for inlet air or exhaust, as the case may be, in a single cylinder. Each valve 10 includes a valve head 16 and stem portion 18. Each valve stem portion 18 includes a series of concentric cylindrical sections 20, 22, 24 and 26 of varying outer diameter. The sections 20 and 24 guide each valve 10 for reciprocation within each respective guide bore 28. Each cylindrical section 26 constitutes a valve piston fixed atop its respective valve stem portion 18. Each valve piston 26 is slidable within the limits of its own piston chamber 30 that is concentric with guide bore 28. Fluid is selectively supplied to pistons 26 from a high pressure rail 40 and a low pressure rail 42 hydraulically connected through high pressure line 44 and low pressure line 46, respectively.

A hydraulic system for maintaining necessary fluid pressures in the high and low pressure rails is also illustrated in FIG. 1. The hydraulic system disclosed is only one example of a hydraulic system configuration that will work; other configurations of hydraulic systems can also be used. The hydraulic system illustrated includes a variable displacement pump 52 between a reservoir 54 and the high pressure rail 40. Since the fluid in the high pressure rail 40 is subject only to expansion and contraction, the pumping work of the pump 52 is largely limited to that necessary to compensate for internal leakage through clearances. Variable displacement pump 52 may be under automatic control whereby a pressure sensor 56 will produce a pressure feedback signal to a pump controller 58 in the event pressure in the high pressure rail 40 drops below a set minimum required at any particular vehicle speed or other operating condition. This then varies the pump displacement to maintain the required pressure in the high pressure rail 40. Fluid in the low pressure rail 42 is maintained at a fixed pressure, lower than the high pressure rail 40, by means of pressure pump 60 supplying fluid from reservoir 54 and pressure regulator 62.

The volume 25 above each piston 26 is selectively connected to the high pressure line 44 through a high pressure actuation valve, such as a high pressure solenoid valve 64, or a high pressure check valve 66, or to the low pressure line 46 through a low pressure actuation valve, such as a low pressure solenoid valve 68, or a low pressure check valve 70. While solenoid valves are illustrated herein, other types of valves other than solenoid valves can be used to control the flow of hydraulic fluid. The volume 27 below each piston 26 is always connected to the high pressure rail 40. Fluid return lines 72 provide a means for returning to the reservoir 54 any fluid which leaks out of the piston chambers 30.

A solenoid valve control means 74 is electronically connected to the two solenoid valves 64 and 68 to actuate them. The engine valve opening is controlled by the high-pressure solenoid valve 64 which, when opened, causes engine valve acceleration, and when closed, causes deceleration. Opening and closing of the low pressure solenoid valve 68 controls the engine valve closing.

During engine valve opening, the high pressure solenoid valve 64 opens and the net pressure force acting on the valve pistons 26 accelerates each engine valve 10 downward. The high pressure solenoid valve 64 then closes and pressure above the pistons 26 drops, causing each piston 26 to decelerate, pushing the fluid from the volume 27 below it back into the high pressure rail 40. Low pressure fluid flowing through the check valve 70 prevents void formation in the volumes 25 above the pistons 26 during deceleration. When the downward motion of each valve 10 ceases, the low pressure check valve 70 closes and the engine valves 10 remain locked in their open position.

The process of valve closing is similar, in principle, to that of valve opening. When the low pressure solenoid valve 68 opens, the pressure above each of the pistons 26 drops and the net pressure force acting on each piston 26 accelerates the engine valves 10 upward. The low pressure solenoid valve 68 then closes and the rising pressure above each piston 26 opens the high pressure check valve 66. The engine valves 10 decelerate pushing the fluid from the volumes 25 above the pistons 26 back into the high pressure rail 40. The high pressure check valve 66 closes and the engine valves 10 remain locked in the closed position.

In this system, where a set of engine valves 10 are operated with one set of hydraulic controls, the system is statically indeterminate. Because of this, a slight difference in viscous drag or tolerances between the two engine valves 10 or in the hydraulic lines can lead to engine valves 10 within a pair that do not have identical opening and closing characteristics. Consequently, there is always a possibility that one of the valves 10 will move faster so that the amount of the valve lift will be different for the two engine valves 10.

To account for this, a pair of valve balancing springs 80 is used. One spring 80 is located under each of the valve pistons 26. The purpose of the balancing springs 80 is to balance the motion of the two engine valves 10. The balancing springs 80 are substantially identical and their pre-loads are equal when the two engine valves 10 are in their closed positions. With this arrangement, if one of the engine valves 10 moves faster than the other during engine valve opening, its balancing spring 80 will experience greater compression force than the balancing spring 80 in the slower moving engine valve 10, which will tend to equalize the speed between the two. Further, when each is in its fully open position, if the two engine valves 10 have reached unequal maximum lifts, then the two balancing springs 80 will have unequal compression, and the resultant different compression forces will tend to move the two engine valves 10 to equal lift positions in which the two balancing springs 80 are equally compressed.

Similarly, during engine valve closing, if one of the engine valves 10 lags behind the other, its balancing spring 80 will experience greater compression force and this will accelerate the lagging engine valve 10 more than the other spring 80 will accelerate its respective valve 10. In this way, the differences in motions of the two engine valves 10 will be minimized, if not eliminated.

Generally, the balancing springs 80 are sized to provide only the minimum force needed to balance the motion of the two engine valves 10. The relative forces exerted by the balancing springs 80 are substantially less than the net force exerted by the hydraulic fluid pressure. The hydraulic fluid pressure acting on the valve pistons 26 does most of the work when moving the engine valves 10 to their open and closed positions. The balancing springs 80 are primarily only for balancing, not the primary movers for closing the engine valves 10, allowing the hydraulic system to do the work of opening and closing the engine valves 10.

While certain embodiments of the present invention have been described in detail, those familiar with the art to which this invention relates will recognize various alternative designs and embodiments for practicing the invention as defined by the following claims.

We claim:

1. A hydraulically operated valve control system for an internal combustion engine having at least one cylinder, the system comprising:

a high pressure source of fluid and a low pressure source of fluid;

a cylinder head member adapted to be affixed to the engine and including an enclosed bore and chamber for each engine valve;

a set of engine valves of a same function for the cylinder shiftable between a first position and a second fully open position within a respective said enclosed cylinder head bore and chamber;

a hydraulic actuator having a set of valve pistons, with each one of the valve pistons coupled to a corresponding one of the engine valves and reciprocates within the enclosed chambers which thereby form first and second cavities in each chamber that vary in volume as the engine valves move;

a high pressure line extending within the cylinder head between the first and second cavities of each of the chambers and the high pressure source of fluid, and a low pressure line extending between the first cavities of each of the chambers and the low pressure source of fluid;

a high pressure valve and a low pressure valve for respectively regulating the flow of fluid in each of the first cavities;

control means cooperating with the high and low pressure valves for selectively coupling each of the first cavities to the high pressure and low pressure source to oscillate the set of engine valves in timed relation to engine operation; and a set of balancing springs, each balancing spring of the set of balancing springs operatively engaging a respective one of the valve pistons wherein each of the balancing springs of the set of balancing springs exerts a spring force on its respective valve piston, between the first and second valve positions inclusive, that is less than the hydraulic forces acting on that valve piston from the first and second cavities.

2. The hydraulically operated valve control system of claim 1 wherein the set of engine valves comprises a pair of intake valves.

3. The hydraulically operated valve control system of claim 1 wherein the set of engine valves comprises a pair of exhaust valves.

* * * * *